US006495660B2

(12) United States Patent
Long

(10) Patent No.: US 6,495,660 B2
(45) Date of Patent: Dec. 17, 2002

(54) POLYAMIDE SUBSTRATE

(75) Inventor: Donald Ray Long, Colonial Heights, VA (US)

(73) Assignee: Honeywell International Inc, Morristown, NJ (US)

( * ) Notice: Subject to any disclaimer, the term of this patent is extended or adjusted under 35 U.S.C. 154(b) by 0 days.

(21) Appl. No.: 09/864,034

(22) Filed: May 23, 2001

(65) Prior Publication Data

US 2002/0002267 A1 Jan. 3, 2002

Related U.S. Application Data

(63) Continuation-in-part of application No. 09/421,570, filed on Oct. 20, 1999, now abandoned.

(51) Int. Cl.[7] ..... C08F 6/00; C08J 3/00; D06P 5/02; D06M 13/00

(52) U.S. Cl. ..... 528/480; 528/310; 528/322; 528/491; 528/492; 8/442; 8/490; 8/531; 8/568; 8/673; 8/674; 8/675; 8/676; 8/685; 8/687; 8/692; 8/924

(58) Field of Search ..... 528/310, 322, 528/480, 491, 492; 8/442, 490, 531, 568, 673, 674, 675, 676, 685, 687, 692, 924

(56) References Cited

U.S. PATENT DOCUMENTS

| | | | | |
|---|---|---|---|---|
| 2,071,150 | A | 2/1937 | Wolfe | 132/19 |
| 2,071,253 | A | 2/1937 | Carothers | 260/112 |
| 2,130,523 | A | 9/1938 | Carothers | 260/124 |
| 2,130,948 | A | 9/1938 | Carothers | 18/54 |
| 3,287,324 | A | 11/1966 | Sweeney | 260/78 |
| 3,671,542 | A | 6/1972 | Kwolek | 260/308 |
| 4,237,187 | A | 12/1980 | Raybon, Jr. et al. | 428/399 |
| 5,181,935 | A | 1/1993 | Reinert et al. | 8/442 |
| 5,618,909 | A | 4/1997 | Lofquist et al. | 528/310 |
| 5,814,107 | A | 9/1998 | Gadoury et al. | 8/422 |
| 5,851,238 | A | 12/1998 | Gadoury et al. | 8/442 |

FOREIGN PATENT DOCUMENTS

| | | |
|---|---|---|
| EP | 0822275 | 4/1998 |

OTHER PUBLICATIONS

Encyclopedia Polymer Science and Engineering, 2nd Edition, vol. 11, "Polyamides" (1988) pp. 315–381.

*Primary Examiner*—P. Hampton-Hightower
(74) *Attorney, Agent, or Firm*—Virginia Szigeti; Roger H. Criss; Margaret S. Millikin

(57) ABSTRACT

A process for making a polyamide substrate characterized by enhanced breaking strength and fade resistance is disclosed. The process features the steps of treating a polyamide substrate, preferably a nylon 6 substrate having a hindered amine light stabilizer chemically bound thereto, with an effective amount of an ultraviolet inhibitor, an antioxidant and optionally, a dye, in the presence of a swelling agent for the polyamide that is also a solvent for the ultraviolet inhibitor and the antioxidant to impart high breaking strength to the substrate. A life preserver or other type of buoyancy device may be made from the process. A polyamide fabric comprising a dye, an ultraviolet inhibitor and an antioxidant also is disclosed. When a polyamide fiber of the present invention is exposed to sunlight, the useful life of the fiber is greatly increased compared to untreated polyamide fiber.

22 Claims, 2 Drawing Sheets

POLYAMIDE SUBSTRATE

CROSS-REFERENCE TO RELATED APPLICATIONS

This application is a Continuation-in-part of application Ser. No. 09/421,570 filed Oct. 20, 1999 now abandoned.

This entire disclosure of the prior application(s) is hereby incorporated by reference in its entirety.

BACKGROUND OF THE INVENTION

1. Field of the Invention

The present invention relates to a stabilized polyamide substrate and a process for making the same. More particularly, this invention relates to a fiber or article made from a polyamide polymer, preferably having a hindered amine light stabilizer chemically bound thereto during polymerization, and treated with an antioxidant and ultraviolet inhibitor in the presence of a substance that is a solvent for the antioxidant and ultraviolet inhibitor and is a swelling agent for the polyamide. The treated polyamide substrate, preferably dyed, has unusually high strength as compared with the untreated polyamide substrate, and is useful in devices, and/or fabrics covering same, that are subject to weathering or exposure to severe environmental conditions during normal use.

2. Brief Description of the Related Art

Dyed fabrics woven from organic polymer fibers such as polyamides have been used in flags, decorative banners and as covers for personal flotation devices, such as life preservers. Prolonged exposure to sunlight, commonly referred to as weathering, tends to fade the dyed polyamide material and to reduce its physical properties such as strength retention and resistance to elongation. This occurs when the dye and polymeric components of the material absorb damaging wavelengths of light.

Various organic light stabilizers are known for use with polymer substrates like films, fibers and articles manufactured therefrom. Hindered amine light stabilizers (HALS) have been found to be particularly effective organic light and/or heat stabilizers, with one particularly effective stabilizer being that set forth in U.S. Pat. No. 5,618,909 to Lofquist et al., hereby incorporated by reference. Lofquist et al. discloses an efficient, environmentally friendly process for preparing light stabilized polyamide substrates such as molded objects, films, fibers and fabrics, and in particular flags, decorative banners, and fabric covers for personal flotation devices, with a HALS chemically bound to the polyamide and thus no longer susceptible to migration, leaching, and/or volatilization during downstream processing. Although the disclosed HALS stabilizes the polyamide polymer composition against heat and light, fading and coloration problems still exist when the polymer is dyed and exposed to excessive heat, moisture and light conditions. Particularly affected are dyed polyamide polymers that are used in water safety and water recreational devices, such as life vests, floats, banners, and other such normally weathered devices or fabrics.

It is also known to stabilize polymers against ultraviolet and oxidative deterioration by incorporating benzotriazole derivative ultraviolet absorbers and hindered phenol antioxidants into bulk polymers during melt processing. U.S. Pat. Nos. 3,935,163 and 5,380,774 disclose numerous benzotriazole derivatives and hindered phenol antioxidants suitable for this purpose. The disclosures of U.S. Pat. Nos. 3,935,163 and 5,380,774 are hereby incorporated by reference to the extent not incompatible herewith.

However, it is not always practical to incorporate bulk additives in polymers prior to a fiber spinning operation. The stability of a fiber spinning operation is extremely sensitive to the rheological properties of the polymer. Additives must be compatible with the polymer, must not unduly influence the polymer rheology, and must be capable of being rigorously controlled to a constant concentration. Further, a bulk additive must be incorporated at high concentration in order to provide useful concentrations at the surface of the article where needed. These are serious limitations on allowable materials.

A need exists for an effective method of treating fibers and articles after spinning or melt processing to improve strength retention after exposure to light. Ideally, this method should provide the active constituents at the surfaces of the fibers and be practicable in conjunction with dyeing so that no additional steps are required in manufacturing.

The present invention satisfies these needs. It provides means of improving the strength retention of a polyamide substrate after exposure to light. More particularly, the invention improves the strength retention of fibers and articles by treatment after spinning or melt processing. The method provides the active constituents at the surfaces of fibers and is practicable in conjunction with conventional fiber dyeing.

Determination of effective strength of the substrate, and resulting fibers, results from Weatherometer measurements of the substrate in question after exposure to light. Although desirable, it has proven particularly difficult to manufacture a polyamide substrate possessing a high breaking strength after light exposure, particularly a breaking strength of greater than about 300 Newtons after 300 hours of weathering [Underwriters Laboratories Canada, 300 hours of fading ASTM G26 Xenon Arc and ASTM D5034 Break Strength (Grab Test)]. The present invention achieves this superior breaking strength for polyamide fabric after light exposure.

SUMMARY OF THE INVENTION

The present invention includes a process for preparing a polyamide substrate characterized by high strength, even after extended exposure to light. The process comprises the steps of treating a polyamide substrate, preferably dyed, with an effective amount of an ultraviolet inhibitor and an antioxidant in the presence of a substance that is a solvent for the ultraviolet inhibitor and the antioxidant and is a swelling agent for the polyamide, to thereby impart enhanced breaking strength to the polyamide substrate after exposure to light.

An article made by this process is also within the scope of the present invention, e.g., a film, fiber or molded article, as well as products made therefrom, such as fabrics and fibrous networks. Life preservers and other buoyant device products, as well as fabric covers therefor, are examples of such articles.

The present invention further includes the fabric comprising a polyamide fibrous substrate treated with an ultraviolet inhibitor and an antioxidant, and optionally but preferred, with an acid dye.

The preferred polyamide substrate comprises a heat and/or light stabilizing amount, preferably from about 0.1 to about 1.0, more preferably 0.2 to 0.5 weight percent, of a hindered amine bound thereto by reaction of a functional group of the hindered amine with an end group of a precursor of the polyamide. The preferred hindered amine is represented by the formula:

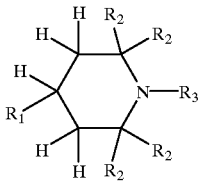

in which $R_1$ comprises the functional group, which is an amine or an amide-forming group:

$R_2$ is alkyl, preferably methyl or ethyl; and $R_3$ is selected from the group consisting of hydrogen; alkyl of 1 to 3 carbons; and —$OR_4$ in which $R_4$ is selected from the group consisting of hydrogen, methyl, and alkyl of 1 to 7 carbons.

When the treated polyamide substrate of the present invention is exposed to sunlight, its useful life is greatly increased compared to untreated polyamide substrates. This is particularly applicable to polyamide fibers and fabrics made therefrom, especially nylon 6 fibers and fabrics.

DESCRIPTION OF THE PREFERRED EMBODIMENTS

Figure 1:
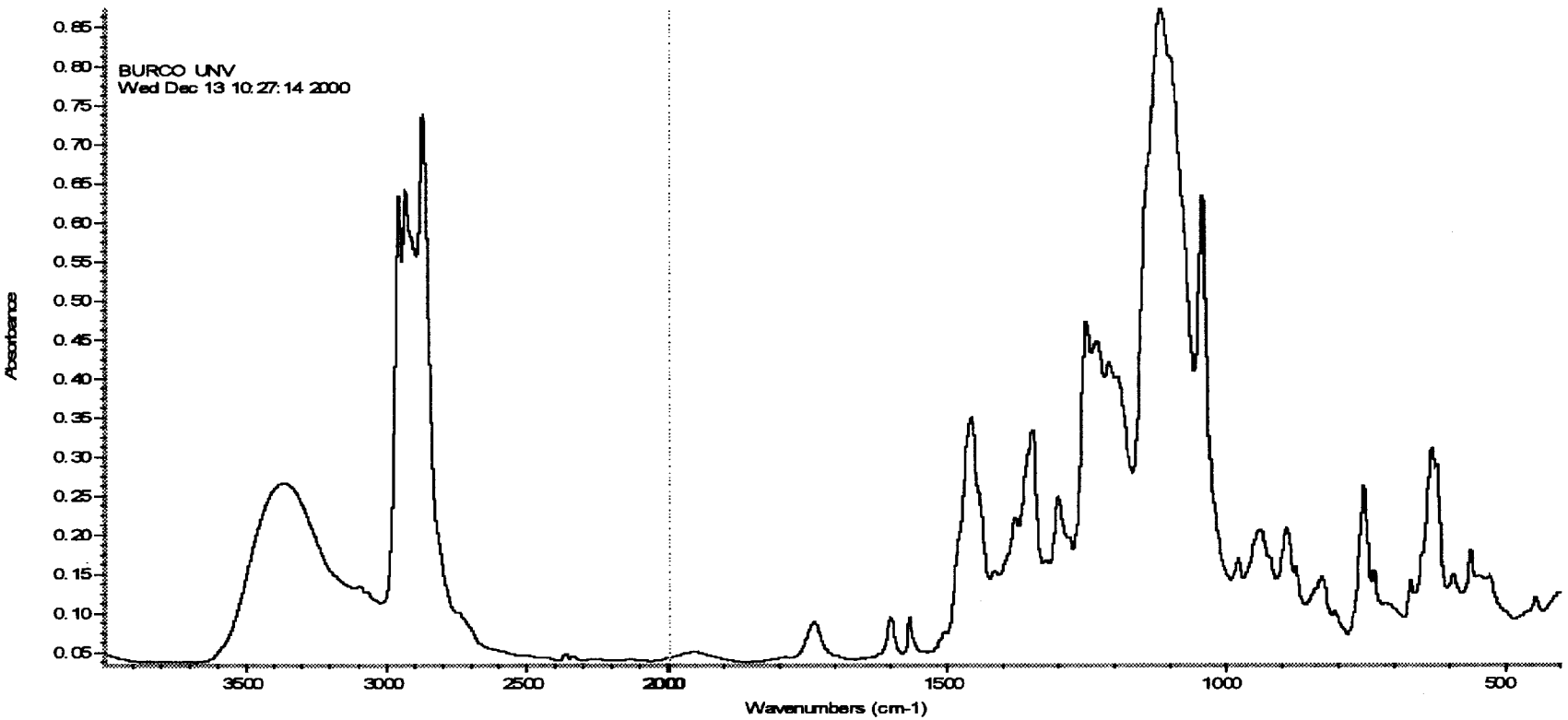
FIG. 1 is an infra-red absorbance spectrum of a preferred ultraviolet inhibitor dissolved in swelling agent for nylon 6.

The present invention includes a process for treating a polyamide substrate, preferably polyamide fiber or fabric formed therefrom, comprising the steps of treating the polyamide substrate with a sufficient (effective) amount of an ultraviolet inhibitor and an antioxidant in the presence of a substance that is a solvent for the ultraviolet inhibitor and the antioxidant and is a swelling agent for the polyamide, to impart a higher breaking strength to the treated substrate, as compared with the untreated substrate after exposure to weathering and/or heat and/or light. The polyamide substrate preferably is dyed either prior to or with the treatment step. The present invention also includes compositions for combination with a polyamide substrate, the compositions comprising an ultraviolet inhibitor, an antioxidant, a swelling agent for the polyamide and optionally a dye, preferably an acid dye.

The preferred substrate is made from polyamide polymer formed by the chemical addition of a hindered amine light stabilizer (HALS) to the polyamide precursor during polymerization. U.S. Pat. No. 5,618,909 teaches how to make such a polymer—the process essentially comprises the steps of reacting a sufficient number of amine and/or amide-forming functional groups of a preferred hindered amine with the end groups of the polyamide precursor(s) at a temperature sufficient for polymerization to occur, to thereby bind the hindered amine to the polyamide and inhibit the subsequent migration, leaching, and volatilization of the hindered amine, especially during downstream processing of the polyamide. This preferred polyamide substrate is a nylon 6 product (chip or fiber) commercially available from AlliedSignal Inc. under the Eclipse name.

The term polyamide as used herein denotes homopolymers, copolymers, blends and grafts of those synthetic long chain polyamides having recurring amide groups as an integral part of the main polymer chain. Exemplary of such polyamides are nylon 6 (polycaprolactam); nylon 6,6 (polyhexamethylene adipamide); nylon 4,6 (poly(tetramethylenediamine-co-adipic acid)); nylon 6,10 (polyhexamethylene sebacamide); nylon 7 (polyenantholactam); nylon 11 (polyaminoundecanamide); nylon 12 (polydodecanolactam), etc. These long chain polyamides are generically referred to as nylons. The term polyamide also denotes the aramids (aromatic polyamides), such as poly (metaphenylene isophthalamide (NOMEX® fiber, U.S. Pat. No. 3,287,324), and poly(p-phenylene terephthalamide) (KEVLAR® fiber, U.S. Pat. No. 3,671,542).

Two principal types of nylon polymerization processes may be used: condensation reactions and addition reactions. Additionally, a controlling agent is used to terminate the reaction between carboxyl end groups and amine end groups of the polymerization. Controlling agents are agents which react with the carboxyl end groups or amine end groups to form unreactive ends, such as hydrocarbon radicals (e.g., methyl, cyclohexyl, phenyl), or alternatively are agents that react with the end groups to form either all carboxyl end groups or all amine end groups. These controlling agents are conventionally referred to as terminators because they tend to terminate the polymerization. Obviously, the greater the concentration of terminators, the better the control of or the greater the resistance to continued polymerization under virtually anhydrous conditions.

In the polymerization of polyamides, it is well known to add such terminators, e.g., cyclohexylamine, to the polyamide precursor(s) to regulate molecular weight. For nylon 6, it is desirable to regulate molecular weight during polymerization so that further processing can be done without greatly increasing the molecular weight under the nearly anhydrous conditions of the downstream process. The hindered amine preferably used in the process of this invention substitutes for the terminator insofar as it acts as a monofunctional amine in terminating the end groups of the polyamide precursor(s) to thereby control the molecular weight of and, additionally, confer heat and/or light stability on the polyamide polymer. The hindered amine can be used for full or partial substitution for the conventional terminator, according to the desired end product.

The polyamide precursor is preferably selected from the group consisting of lactams, monomers and oligomers of a $C_2$ to $C_{18}$ amino acid; monomers and oligomers of a $C_2$ to $C_{18}$ alkyl diamine with a $C_2$ to $C_{18}$ aliphatic diacid; monomers and oligomers of a $C_2$ to $C_{18}$ alkyl diamine with a $C_8$ to $C_{24}$ aryl diacid or aryl diacid derivative; monomers and oligomers of a $C_6$ to $C_{24}$ aryl diamine with a $C_8$ to $C_{24}$ aryl diacid or aryl diacid derivative; monomers and oligomers of a $C_6$ to $C_{24}$ aryl diamine with a $C_2$ to $C_{18}$ alkyl diacid or alkyl diacid derivative; monomers and oligomers of a $C_8$ to $C_{14}$ aralkyl diamine with a $C_{10}$ to $C_{14}$ aralkyl diacid or diacid derivative; and copolymers thereof. Exemplary $C_2$ to $C_{18}$ amino acids are aminocaproic acid, polyaminocaproic acid, and 11 aminoundecanoic acid. Exemplary $C_2$ to $C_{18}$ alkyl diamines are butane diamine, hexamethylene diamine and dodecanediamine. Exemplary $C_2$ to $C_{18}$ aliphatic diacids are adipic acid, sebacic acid, and decanedicarboxylic acid. Exemplary $C_8$ to $C_{24}$ aryl diacids or aryl diacid derivatives are terephthalic and isophthalic acids. Exemplary $C_6$ to $C_{24}$ aryl diamines are para-phenylenediamine and meta-phenylene diamine. Exemplary $C_8$ to $C_{14}$ aralkyl diamines are meta-xylylenediamine and para-xylylenediamine. Exemplary $C_{10}$ to $C_{14}$ aralkyl diacids or diacid derivatives are phenylenediacetic acid isomers.

The most preferred linear polyamide polymer is nylon 6 wherein the polyamide precursors are caprolactam and aminocaproic acid with carboxyl and amine end groups. For the aramid polymers, the polyamide precursor preferably is either (1) an aryl diamine with an acid halide, and the end groups are selected from the group consisting of carboxylic acid derivatives, amines, and combinations thereof, or (2) an aryl diamine salt with an acid halide, and the end groups are selected from the group consisting of amine salts, amines, carboxylic acid derivatives, and combinations thereof. The preferred acid halides are terephthaloyl chloride and isophthaloyl chloride.

The preferred hindered amine is represented by the formula:

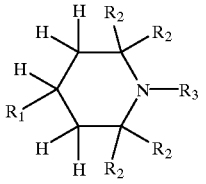

in which $R_1$ comprises the amine or amide-forming functional group;

$R_2$ is alkyl, preferably a methyl or ethyl group, more preferably the former; and $R_3$ is selected from the group consisting of hydrogen; alkyl of 1 to 3 carbons; and —$OR_4$ in which $R_4$ is selected from the group consisting of hydrogen, methyl, and alkyl of 1 to 7 carbons. $R_4$ most preferably is hydrogen.

$R_1$, the amine or amide-forming functional group, is preferably selected from the group consisting of —(NH)$R_5$ where $R_5$ is hydrogen or alkyl of 1 to 8 carbons; carboxyl; carboxylic acid derivative; —$(CH_2)$x(NH)$R_5$, in which X is an integer of from 1 to about 6 and $R_5$ is hydrogen or alkyl of 1 to 8 carbons; —$(CH_2)_Y$COOH, in which Y is an integer of from 1 to about 6; and —$(CH_2)_Y$COOH acid derivative in which Y is an integer of from 1 to about 6. Most preferably $R_1$ is —$NH_2$, —COOH, or —COOH acid derivative.

The most preferred hindered amine is 4-amino-2,2,6,6-tetramethylpiperidine, commercially available from Huls America, Inc., and hereafter referred to as triacetonediamine or "TADA." This light stabilizer is soluble in a molten polymer precursor, e.g., caprolactam for nylon 6, or an aqueous solution of polymer precursor, e.g., hexamethylenediamine adipate for nylon 6,6. The functional group of the hindered amine reacts with the polyamide end group to thereby regulate the molecular weight. The amount of the hindered amine utilized is sufficient to achieve light stabilization of the polyamide substrate. The preferred amount utilized ranges from about 0.1 to about 1, more preferably about 0.2 to about 0.5, weight percent based on the weight of the polyamide substrate.

Reaction temperatures for nylon polymerizations can range from about 180° C. to about 290° C., more preferably from about 225° C. to about 280° C. For the aramids, reaction temperatures range from about −15° C. to about 80° C., more preferably from about −15° C. to about 30° C.

Delusterants are typically added to opacify nylon substrates. Anatase titanium dioxide, one of the better known delusterants for use with nylons, sensitizes the substrate to light. To counteract this, copper salts, manganous salts, and additives such as hypophosphorous acids, phosphites, and phosphates, are frequently added as light stabilizers.

The polyamide substrate of the present invention may be in the form of polyamide fibers, such as nylon 6 fibers commercially available from AlliedSignal Inc. or nylon 6,6 fibers commercially available from E.I. Du Pont de Nemours & Co., and films. Additionally, the polyamide substrate can include molded objects and articles manufactured from polyamide fibers, e.g., fabrics (woven, nonwoven, and knitted), and the like. The preferred polyamide substrates are fabrics made from nylon 6 fibers having a denier per filament of up to about 20, more preferably in the range of about 7 and below.

Polymerization conditions of the polyamide substrate can be found in U.S. Pat. Nos. 2,071,150; 2,071,253; 2,130,523; 2,130,948; 3,287,324; and 3,671,542, which describe the preparation of nylons and aramids, and all of which are hereby incorporated by reference. A high speed process for making fiber from nylon 6 is also set forth in U.S. Pat. No. 4,237,187, also incorporated herein by reference. See also the Encyclopedia of Polymer Science and Engineering, 2d Edition, Volume 11, relating to Polyamides (1988).

The polymerized nylon substrate, preferably in fiber or fabric form, is treated with a dye, an ultraviolet inhibitor, and an antioxidant, serially or in partial or full combination, most preferably the latter, in the presence of a substance that is a solvent for the ultraviolet inhibitor and the antioxidant and is a swelling agent for the polyamide. Treatment preferably occurs with the formed polyamide substrate (such as fiber or fabric) in a bath at elevated temperatures, generally in the range of from about 30° C. to about 100° C., with preferred ranges of from about 50° C. to about 95° C., more preferred from about 70° C. to about 95° C., and most preferred from about 90° C. to about 95° C. However, treatment may be accomplished in stages, with initial mixing and application of the antioxidant and UV inhibitor occurring at lower temperatures, prior to the addition of the dye. Although quality control is reduced, the dye also may be initially set at lower temperatures when first mixed into a bath containing the substrate.

The ultraviolet inhibitor, antioxidant and swelling agent for the polyamide preferably are mixed together prior to treating the polyamide substrate. The dye may be added or applied separately, for example via a separate bath in a separate step before or after treatment with these components, or it may be applied concomitant with the ultraviolet inhibitor and antioxidant via a single treatment bath. If a single bath is used, the dye can be added to the bath at anytime—prior to, with or after the addition of the ultraviolet inhibitor, antioxidant and swelling agent for the polyamide, for treatment of the polyamide substrate. The preferred mixing temperature for the ultraviolet inhibitor, antioxidant and swelling agent combination alone ranges from about 35° C. to about 40° C. (prior to contact with the polyamide substrate). The preferred mixing and application temperature for an acid dye is at least about 82° C. If the dye is added to (mixed with) the ultraviolet inhibitor, antioxidant and swelling agent mixture, it is preferably mixed at a temperature ranging from about 82° C. to about 93° C.

Treatment of the polyamide substrate preferably includes filling a bath containing the substrate with water, bringing to a temperature of from about 35° C. to about 40° C. and adding the ultraviolet inhibitor and antioxidant. After the ultraviolet inhibitor, antioxidant and swelling agent are mixed, the bath is raised to a temperature of from about 90° C. to about 95° C. The pre-dissolved dye (at about 82° C.) is added to the mixed ultraviolet inhibitor and antioxidant bath, and the temperature of the bath is raised to about 90° C. to about 95° C. over a time period of from about 8 to about 12 minutes. The temperature of the bath is held for a period of time of from about 25 minutes to about 35 minutes, with acetic acid incrementally added over a time period of from about 10 minutes to about 20 minutes. The temperature is maintained for a time period of from about 20 minutes or more, and the mixture is cooled to a temperature of from about 60° C. to about 70° C. The treated substrate is rinsed with water.

A product made in accordance with the process preferably is characterized by a breaking strength of at least about 300 Newtons, more preferably at lest about 330 Newtons, after 300 hours of Xenon weathering. Higher breaking strengths, on the order of about 350 Newtons, 500 Newtons, 550 Newtons and 600 Newtons, can be obtained for specific shades.

The preferred fabric composition of the present invention comprises woven nylon 6 fabric, made from Eclipse nylon 6 fiber, commercially available from AlliedSignal Inc., treated with an acid dye, an ultraviolet inhibitor and an antioxidant.

The preferred dyes of the present invention include direct dyes and acid dyes. Direct dyes, also known as substantive dyes, bind to the substrate with electrostatic forces. Direct dyestuffs generally have reactive groups, such as amines ($R—NH_2$), and are dissolved in water where they dissociate into positive sodium cations and negative organic anions. Prior to application of (treatment with) the direct acid, the polyamide substrate of the present invention is pretreated to remove impurities that could interfere with the application of the direct dye onto the substrate. The application of the dye onto the substrate generally occurs at an elevated temperature, such as up to about 100° C. Examples of categories of direct dyes include Direct Yellows, Direct Blues, Direct Reds, Direct Blacks, Direct Oranges, Direct Browns, Direct Violets, and Direct Greens. Specific examples of acceptable direct dyes include Direct Yellow 11, Direct Yellow 147, Direct Red 81, Direct Black 22, Direct Blue 86, Direct Yellow 4, Direct Red 238, Direct Blue 218, and Direct Blue 199.

Direct dye selection is based on factors such as shade, dyeing rate, degree of exhaustion, and water solubility. The dyeing rate and exhaustion are controlled by time, temperature, salt concentration, liquor ratio, dye bath volume, dye concentration, the compatibility of the dyestuff and substrate, and other such factors determinable by one skilled in the art. Dyeing rates, dye exhaustion and salt concentration are proportional to dye bath temperature, within limits. Additionally, as the ratio of substrate to the dye bath volume increases, equilibrium times increase and less total color is exhausted. Dyeing rates initially have rapid rates that level off, for example within from about 45 minutes or less. However, the substrate may be kept in contact with the dye bath to ensure uniform coloring.

Exemplary dye bath procedures for direct dyes may include dissolving the direct dyestuff in cold water and adding hot water to raise the dye bath temperature slowly to from about 50° C. to about 60° C. Salt, such as sodium sulfate or sodium chloride, is then added to the dye bath in a range of from about 10% to about 40% based on substrate weight. The dye bath is heated to shift the equilibrium of the single anions over the molecular anions. The direct dyestuff is added to the cool water and the temperature raised slowly to avoid insoluble lumps that can form if the direct dyestuff is added to hot water.

The preferred dye of the present invention is an acid dye. Acid dyes are anionic dyes normally applied to a fabric being dyed in organic or inorganic acid dyeing solutions. Acid dyes are large dyes containing one or more sulfonic or carboxylic acid salt functional groups. As the substrate of the present invention develops a positive charge in the presence of acid, the colored anion is driven into the substrate. Acid dyes are of relatively low molecular weight and carry from about one to about three sulfonic acid groups ($R—SO_3Na$). The sulfonic acid groups dissociate in water, or other acidic solutions to form anions and cations. The anions are colored and contain the structure $R—SO^-_3$, and the cations ($Na^+$) are colorless. Acid dyes are applied at elevated temperatures, such as from about 85° C. to about 100° C. or more onto the polyamide substrate of the present invention. The elevated temperature causes the dyes to condense on the polyamide substrate.

The acid dyes include azo, anthraquinone, triarylmethane, pyrazolone, azine, nitro, and/or quiniline dyes. Preferred acid dyes include azo, anthraquinone, and triarylmethane dyes. The sulfonated acid dyes include leveling dyes, milling dyes, and pre-metallized dyes. The leveling dyes are generally monosulfonic and applied with highly acidic, weakly acidic and neutral dye baths onto the substrate, combined with a tannic acid/tartar emetic and/or other synthetic fixer. Preferred leveling dyes include Acid Blue 80 and Acid Red 337.

The milling dyes of the present invention include dyes of higher molecular weight than leveling dyes, and with di-sulfonated or polysulfonated groups. Generally, the milling dyes are applied from weak acidic dye baths, for example, acetic acid, with the dye bath having a pH of from about 5 to about 6.2. Preferred milling dyes include super milling dyes, having higher molecular weight, that are applicable from neutral solutions.

Pre-metallized acid dyes of the present invention preferably comprise sulfonated and unsulfonated metal complex dyes with a metal ion, such as chromium, cobalt or nickel, the sulfonated complex of a cobalt or nickel ion being preferred. Sulfonated pre-metallized acid dyes generally require a strong acidic dye bath application.

The amount of acid dye required to effectively create a dyed nylon fiber/fabric possessing the requisite strength characteristics after exposure to light is proportional to the shade desired. Shades of dye are expressed as a percentage of weight dye to weight fabric. Acid dyes include classifications such as Acid Yellows, Acid Blues, Acid Oranges, Acid Reds, Acid Blacks, Acid Browns, Acid Greens, and Acid Violets. Exemplary acid dyes of the present invention include Burconyl Yellow M-R 250%, Burconyl Violet FBL 200%, Burconyl Blue RL 200% Burcolan Bordeaux R Conc, Burcolan Blue 3G 200% and Burconyl Turquoise AF-RP, all available from Burlington Chemical of Burlington, N.C. The shade of the acid dyes may include any suitable shade for a particular situation. Preferably the acid dye comprises a dye shade selected from the group consisting of teal, Ocean Blue, purple, and Reflex Blue. More preferably, the acid dye comprises a dye shade of purple or Reflex Blue.

Suitable ultraviolet inhibitors are light absorbers such as benzophenones, benzotriazoles and oxanilides, s-triazines and cyanoacrylates, and/or derivatives thereof. Benzotriazoles are preferred. Most preferred is a benzotriazole dissolved in a swelling agent for polyamides such as BURCO® UVN sold commercially by Burlington Chemical Co. The composition of the BURCO® UVN used in the examples of this invention is uniquely defined by the infra-red absorbance spectrum shown in FIG. 1. Amounts of the ultraviolet light absorber range from about 1.5 to about 3.0 weight percent of the composition. Preferably the amount of ultraviolet light absorber ranges from about 2.0 to about 2.5 weight percent.

The antioxidant of the present invention may include amine-antioxidants, blocked amine antioxidants, or other antioxidants known to those skilled in the art. Preferably, the antioxidant is a hindered phenol such as has been described in U.S. Pat. No. 3,935,163 heretofore incorporated by reference. The antioxidant comprises from about 0.5 to about 4.0 weight percent of the composition. Preferably, the amount of antioxidant comprises from about 0.5 to about 2.0 weight percent for medium-to-dark shades, more preferably from about 1.0 to about 2.0 weight percent, and most preferably from about 1.5 to about 2.0 weight percent. For light shades, the amount of antioxidant preferably comprises from about 2.0 to about 3.5 weight percent, more preferably from about 2.5 to about 3.5 weight percent, and most preferably from about 3.0 to about 3.5 weight percent. Preferably, the antioxidant comprises BURCO® NPS sold commercially by Burlington Chemical Co. The composition of the BURCO® NPS used in the examples of this invention is uniquely defined by the infra-red absorbance spectrum shown in FIG. 2. BURCO® NPS contains a hindered phenol antioxidant together with caprolactam, a swelling agent for polyamides.

The swelling agent for the polyamide must also be a solvent for the ultraviolet inhibitor and the antioxidant. The preferred swelling agent is at least one member selected from the group consisting of caprolactam, ethylene glycol, diethylene glycol, triethylene glycol, a monoalkly ether of diethylene glycol, a dialklyl ether of diethylene glycol, a monoalkly ether of triethylene glycol and a dialkyl ether of triethylene glycol. The most preferred swelling agent is at least one member of the group consisting of caprolactam, diethylene glycol monobutyl ether and triethylene glycol monobutyl ether. The concentration of the swelling agent is at least 10% of the total of the concentrations of the ultraviolet inhibitor and the antioxidant. Preferably, the concentration of the swelling agent is at least 20% of the total of the concentrations of the ultraviolet inhibitor and the antioxidant. Most preferably, the concentration of the swelling agent is at least 40% of the total of the concentrations of the ultraviolet inhibitor and the antioxidant.

Without being held to a particular theory of why the compositions of the invention are effective, it is believed that the swelling agent, by loosening the molecular network comprising the polyamide, permits a synergistic acceleration of the rates of diffusion of the ultraviolet inhibitor and the antioxidant into the surface layers of the polyamide. When the polyamide is dried, the ultraviolet inhibitor and the antioxidant are locked into the polymer. This provides high permanent concentrations of the active materials in the surface precisely where they are needed to overcome the effects of light exposure.

Additional components may be added as needed, such as defoamers; alkalis such as caustic soda or sodium hydroxide (NaOH), soda ash or sodium carbonate ($Na_2CO_3$), lime (CaO), ammonia ($NH_3$) and/or potash or potassium carbonate ($K_2CO_3.2H_2O$); reducing agents such as sodium sulfide ($Na_2S$ or $Na_2S.9H_2O$), sodium bisulphite ($NaHSO_3$), sodium hydrosulphite ($Na_2S_2O_4.2HCHO.4H_2O$), zinc dust and/or ferrous sulphate or copperas ($FeSO_4.7H_2O$); exhaustants such as sodium chloride or common salt (NaCl), sodium sulfate or Glauber's salt ($Na_2SO_4.10H_2O$), ammonium chloride ($NH_4Cl$) and/or ammonium sulfate ($(NH_4)_2SO_4$); souring agents such as sulfuric acid ($H_2SO_4$), hydrochloric acid (HCl), acetic acid ($CH_3COOH$) and /or formic acid (H.COOH); oxidants such as hydrogen peroxide ($H_2O_2$), sodium peroxide ($Na_2O_2$), sodium perborate ($NaBO_3.4H_2O$), sodium nitrite ($NaNO_2$), sodium bichromate ($NaCr_2O_7.2H_2O$), potassium bichromate ($K_2Cr_2O_7$) and/or ammonium sulfocyanide ($NH_4CNS$); and/or other auxiliary compounds such as Fullers' Earth, Turkey Red Oils, Monopol Brilliant Oil, Monopol Soap, Glue, Wast Sulphite Cellulose Lye, Nekal B extra, Albatex PO, Peregal O, and/or Prestabit Oil or Calsolene Oil HS.

Products made in accordance with the process of the present invention have a multitude of uses. Applications where weathering or exposure to sunlight are a major concern include, by way of example, outdoor clothing, interior automotive fabrics, marine fabrics, marine slings, marine ropes, cordage, agricultural fabrics, awnings, tarps, canopies, tents, flags, banners, outdoor furniture, sports equipment, personal flotation devices including life preservers and other such buoyancy devices, sails, parachutes, soft-sided luggage, geotextiles, animal control webbing, cargo tie-downs/covers, boat covers, deck covers, industrial lifting slings, military webbing, parachute harnesses, mailbags, drapes, seat belt webbing, exterior automotive molded parts.

The following Examples 1 through 8 are presented to provide a more complete understanding of the invention and are not to be construed as limitations thereon. Samples for treatment and testing were made as follows. A 200 denier, 32 filament bright nylon 6 yarn, commercially available from AlliedSignal Inc. as Eclipse fiber and made generally in accordance with the procedure set forth in Examples 1 (fiber spinning) and 2 (polymer formulation) of U.S. Pat. No. 5,618,909 to Lofquist et al., was woven into a broadwoven fabric [plain weave characterized by 60×50 ends per inch (2.54 cm)] having a finished width of 60 inches (150 cm). Samples of about 12×24 inches (30×60 cm) were cut for treatment and testing in the examples that follow.

In the examples, the breaking strengths of the fabrics were determined based on Underwriters Laboratories Canada, 300 hours of fading ASTM G26 Xenon Arc and ASTM D5034 Break Strength. The reported breaking strength measurements (Newtons) represent an average of five breaks. Those fabrics characterized by a breaking strength of at least about 300 Newtons are highly preferred.

Example 1

In the first example, an acid dye of 0.016% Burconyl® Yellow M-R 250%, 0.300% Burconyl® Violet FBL 200% and 1.060% Burconyl Blue RL 200% was used to create a Reflex Blue 131609 shade. The acid dye was pre-dissolved in water at about 82° C. One of the fabric samples was added to an aqueous bath. The bath was set at 38° C. (100° F.), and 2.00% of Burcolev® HCDB, 2.00% BURCO® NPS antioxidant (FIG. 2), 3.00% BURCO® UVN (FIG. 1) ultraviolet inhibitor and 1.25 g/L of BURCO® Acid Donator (pH 7.5–8.0) were added.

Swelling agents for the polyamide were caprolactam incorporated in the BURCO® NPS and triethylene glycol monobutyl ether incorporated in the BURCO® UVN. The BURCO® UVN was comprised of 15 wt % caprolactam. The BURCO® UVN was comprised of 70 wt % triethylene glycol monobutyl ether. The concentration of the swelling agents was 48% of the total of the concentrations of the ultraviolet inhibitor and the antioxidant.

A defoamer of BURCO® Defoamer X-CLR was added, as required. The bath was circulated for 10 minutes and the pre-dissolved acid dye was added. The bath continued to circulate for 10 minutes and was raised to a temperature of 93° C. at a rate of 1.5° C. per minute. The temperature was held at about 93° C. for 30 minutes, and 0.50% acetic acid 56% was slowly added over 15 minutes. The temperature was held at about 93° C. for an additional 20 minutes. The bath was cooled to 60° C., and the nylon substrate was rinsed well and thereafter dried.

For comparison, a second fabric sample was treated in another bath in an identical manner except that the antioxidant, UV inhibitor and swelling agents were excluded from the bath.

The dyed fabric treated with the antioxidant and UV inhibitor in the presence of swelling agents exhibited a breaking strength of 609 Newtons, more than 200% higher than the 291 Newtons exhibited by the dyed fabric without treatment with the antioxidant, UV inhibitor and swelling agents.

Example 2

Example 1 was repeated, with an acid dye of 0.950% Burconyl® Violet FBL 200% used to create a Purple B0466 shade. The dyed fabric treated with the antioxidant UV inhibitor and swelling agents exhibited a breaking strength of 560 Newtons, more than 250% higher than the 204 Newtons exhibited by the dyed fabric without treatment.

Example 3

Example 1 was repeated, with an acid dye of 0.115% Burconyl® Violet FBL 200%, 0.480% Burconyl Blue RL 200% and of 0.520% Burcolan® Bordeaux R Conc used to create a Purple B2532 shade. The dyed fabric treated with the antioxidant UV inhibitor and swelling agents exhibited a breaking strength of 502 Newtons, about 150% higher than the 351 Newtons exhibited by the dyed fabric without treatment.

Example 4

Example 1 was repeated, with an acid dye of 0.075% Burcolan Blue 3GL 200% and 1.560% Burconyl® Turquoise AF-RP used to create a Ocean B1537 shade. The dyed fabric treated with the antioxidant, UV inhibitor and swelling agents exhibited a breaking strength of 298 Newtons, more than 25% higher than the 236 Newtons exhibited by the dyed fabric without treatment.

Example 5

Example 1 was repeated, with an acid dye of 0.016% Burconyl® Yellow M-R 250%, 0.150% Burconyl Violet FBL 200% and 1.060% Burconyl® Blue RL 200% used to create a Reflex Blue B1609 shade. The dyed fabric treated with the antioxidant and UV inhibitor exhibited a breaking strength of 609 Newtons, more than 250% higher than the 231 Newtons exhibited by the dyed fabric without treatment.

Example 6

Example 1 was repeated, with an acid dye of 0.055% Burconyl Yellow M-R 250%, of 0.180% Burcolan® Blue 3GL 200% and 1.200% Burconyl® Turquoise AF-RP used to create a Teal B2895 shade. The dyed fabric treated with the antioxidant, UV inhibitor and swelling agents exhibited a breaking strength of 320 Newtons, over 12% higher than the 285 Newtons exhibited by the dyed fabric without treatment.

Example 7

Example 1 was repeated, with an acid dye of 0.140% Burconyl® Yellow M-R 250%, 0.120% Burcolan® Blue 3GL 200% and 1.600% Burconyl® Turquoise AF-RP used to create a Teal 2810 shade. The dyed fabric treated with the antioxidant, UV inhibitor and swelling agents exhibited a breaking strength of 276 Newtons, almost 8% higher than the 258 Newtons exhibited by the dyed fabric without treatment.

Example 8

Example 1 was repeated, with an acid dye of 0.046% Burconyl Yellow M-R 250%, of 0.025% Burcolan® Blue 3GL 200% and 0.720% Burconyl® Turquoise AF-RP used to create a Teal 2895 shade. The dyed fabric treated with the antioxidant, UV inhibitor and swelling agents exhibited a breaking strength of 325 Newtons, over 10% higher than the 293 Newtons exhibited by the dyed fabric without treatment.

Discussion

Examples 1 through 8 exemplify a polyamide substrate with a chemically bound hindered amine light stabilizer treated with a dye, an ultraviolet inhibitor, and an antioxidant in the presence of polyamide swelling agents. The examples show that treatment imparts greater stability to the substrate as exhibited by the substantial, even stunning for certain dye shades, relative increase in breaking strength.

These relative breaking strengths demonstrate that the incorporation of the dye, ultraviolet inhibitor, and antioxidant with the polyamide substrate in the presence of the swelling agents greatly increases the breaking strength of the substrate and therefore the expected life of a fiber or fabric (e.g., dyed flags, banners, fabrics or ropes) or article made therefrom.

In addition to the enhanced breaking strength, the dyed polyamide substrates of the present invention also exhibited improved lightfastness (i.e., faded less than untreated substrates), especially for the brighter shades utilized with fabrics for personal flotation devices and other safety devices, typically used outside where weathering is an issue and in situations where the bright color is necessary for attention/safety, e.g., hats or blazers for hunters.

The foregoing summary, description, and examples of the present invention are not intended to be limiting, but are only exemplary of the inventive features that are defined in the claims.

I claim:

1. A process for making a polyamide substrate of enhanced breaking strength after exposure to light comprising:

(a) treating a polyamide substrate with an effective amount of an ultraviolet inhibitor, an antioxidant, a swelling agent for the polyamide that is a solvent for the ultraviolet inhibitor and the antioxidant, and optionally, a dye; and (b) drying the polyamide to fix the ultraviolet inhibitor and antioxidant into the polyamide.

2. The process of claim 1 wherein the ultraviolet inhibitor and the antioxidant and swelling agent are mixed together for said treating step.

3. The process of claim 1 wherein the ultraviolet inhibitor and the antioxidant are mixed together with an acid dye for treating the substrate.

4. The process of claim 1 wherein the step of treating the nylon substrate occurs in a bath.

5. The process of claim 1 wherein the substrate is dyed prior to said treatment step and wherein the ultraviolet inhibitor and antioxidant are padded on the dyed substrate followed by drying.

6. The process of claim 1 wherein the dye comprises a direct or acid dye.

7. The process of claim 1 wherein the dye is a sulfonated acid dye selected from the group consisting of neutralized acid dyes, milling acid dyes, and pre-metallized acid dyes.

8. The process of claim 7 wherein the pre-metallized acid dye comprises a sulfonated complex of a cobalt or nickel metal compound.

9. The process of claim 1 wherein the dye comprises a sulfonated direct dye.

10. The process of claim 9 wherein the dye is selected from the group consisting of teal, blue and black.

11. The process of claim 1 wherein the polyamide has a hindered amine light stabilizer chemically bound thereto.

12. The process of claim 4 wherein the treating bath comprises from about 1.5 to about 3.0 weight percent ultraviolet inhibitor and from about 0.5 to about 4.0 weight percent antioxidant, and wherein the swelling agent concentration is at least 10% of the total concentration of ultraviolet inhibitor and antioxidant.

13. A process for making a polyamide substrate of enhanced breaking strength after exposure to light, comprising:

(a) treating a polyamide substrate in a bath, said bath comprising about 1.5 to about 3.0 weight percent an ultraviolet inhibitor, about 0.5 to about 4.0 weight percent an antioxidant, a swelling agent for the polyamide that is a solvent for the ultraviolet inhibitor and the antioxidant, and optionally, a dye; and (b) drying the polyamide to fix the ultraviolet inhibitor and antoxidant into the polyamide;

wherein the swelling agent concentration is at least 10% of the total concentration of the ultraviolet inhibitor and the antioxidant, and wherein the ultraviolet inhibitor is a benzontriazole, the antioxidant is a hindered phenol and the swelling agent is at least one member selected from the group consisting of caprolactam, a monoalkyl ether of diethylene glycol, a dialkyl, a dialkyl ether of diethylene glycol, a monoalkyl ether of triethylene glycol, and a dialkyl ether of triethylene glycol.

14. The process of claim 13 wherein the monoalkyl ether of diethylene glycol is diethylene glycol monobutyl ether, and the monoalkyl ether of triethylene glycol is triethylene glycol monobutyl ether.

Figure 2:
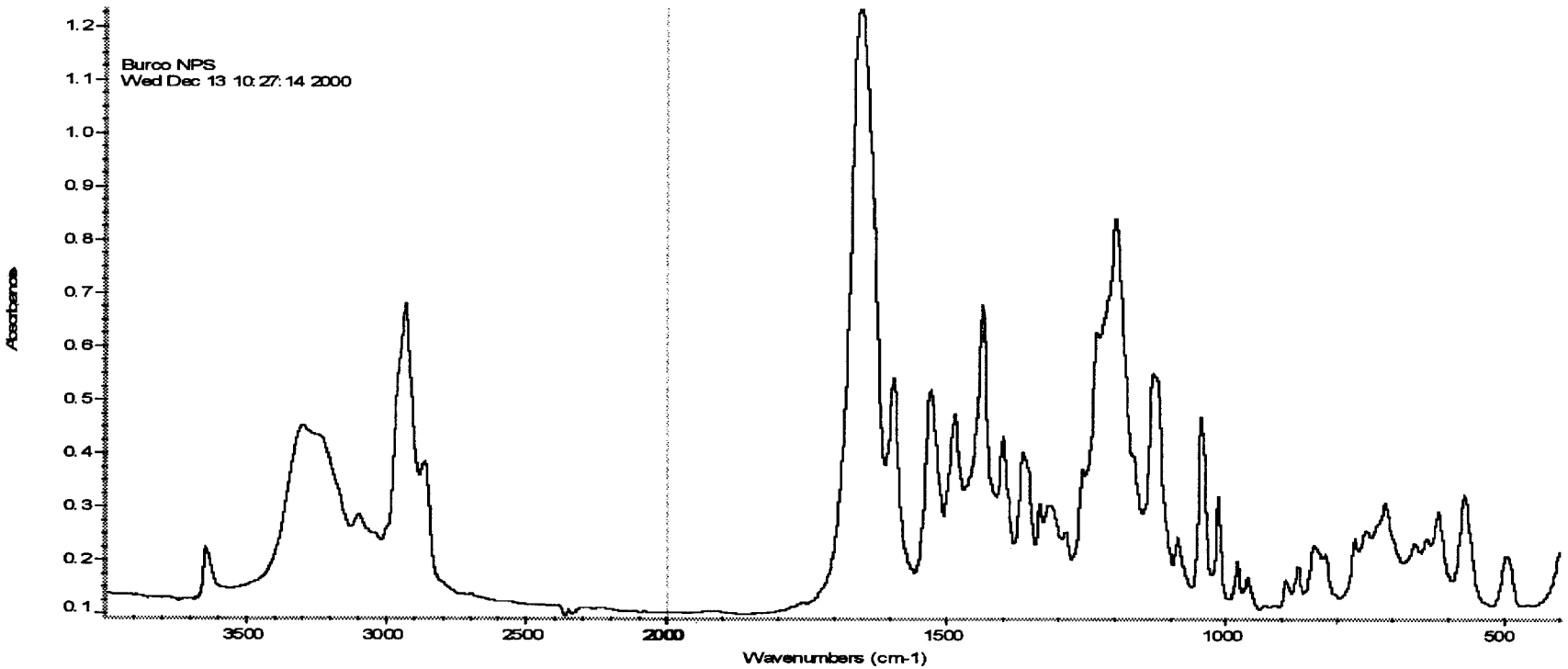
FIG. 2 is an infra-red absorbance spectrum of a preferred hindered phenol antioxidant dissolved in a swelling agent for nylon 6.

15. A process for making a polyamide substrate of enhanced breaking strength after exposure to light, comprising:

(a) treating a polyamide substrate in a bath, said bath comprising about 1.5 to about 3.0 weight percent an ultrabiolet inhibitor, about 0.5 to about 4.0 weight percent an antioxidant, a swelling agent for the polyamide that is a solvent for the ultraviolet inhibitor and the antioxidant, and optionally, a dye; and (b) drying the polyamide to fix the ultraviolet inhibitor and antoxidant into the polyamide;

wherein the swelling agent concentration is at least 10% of the total concentration of the ultraviolet inhibitor and the antioxidant, and wherein the ultraviolet inhibitor and at least one constituent of the swelling agent has the infra-red absorbance spectrum of FIG. 1, and the antoxidant and at least one constituent of the swelling agent has the infra-red absorbance spectrum of FIG 2.

16. A product made in accordance with the process of claim 1.

17. The product of claim 16, characterized by a breaking strength of about 300 Newtons or more after 300 hours of Xenon weathering.

18. A product made in accordance with the process of claim 11.

19. The product of claim 18 wherein the polyamide substrate comprises a nylon 6 fiber.

20.The fiber of claim 19 characterized by a breaking strength of about 300 Newtons or more after 300 hours of Xenon weathering.

21. A fabric made of the polyamide substrate of claim 18.

22. A personal flotation device cover made of the fabric of claim 21.

* * * * *